US012378030B2

(12) United States Patent
Männle

(10) Patent No.: US 12,378,030 B2
(45) Date of Patent: Aug. 5, 2025

(54) APPLICATION DEVICE, APPLICATION APPARATUS AND METHOD FOR APPLYING ADDITIONAL ELEMENTS TO PACKAGES

(71) Applicant: SIG Services AG, Neuhausen am Rheinfall (CH)

(72) Inventor: Andreas Männle, Singen (DE)

(73) Assignee: SIG Services AG, Neuhausen am Rheinfall (CH)

( * ) Notice: Subject to any disclaimer, the term of this patent is extended or adjusted under 35 U.S.C. 154(b) by 227 days.

(21) Appl. No.: 16/607,401

(22) PCT Filed: Apr. 23, 2018

(86) PCT No.: PCT/EP2018/060338
§ 371 (c)(1),
(2) Date: Oct. 23, 2019

(87) PCT Pub. No.: WO2018/197411
PCT Pub. Date: Nov. 1, 2018

(65) Prior Publication Data

US 2020/0130881 A1 Apr. 30, 2020

(30) Foreign Application Priority Data

Apr. 27, 2017 (DE) ..... 10 2017 109 124.6

(51) Int. Cl.
*B65B 61/20* (2006.01)
*B65B 35/16* (2006.01)
(Continued)

(52) U.S. Cl.
CPC ..... *B65B 61/205* (2013.01); *B65B 35/16* (2013.01); *B65B 35/24* (2013.01); *B65B 35/26* (2013.01); *B65B 61/202* (2013.01)

(58) Field of Classification Search
CPC ..... B65B 61/205; B65B 61/202; B65B 35/16; B65B 35/24; B65B 35/26
See application file for complete search history.

(56) References Cited

U.S. PATENT DOCUMENTS 3,440,116 A 4/1969 Whitecar
4,293,369 A 10/1981 Dilot et al.
(Continued)

FOREIGN PATENT DOCUMENTS

CN 1274325 A 11/2000
CN 1753813 A 3/2006
(Continued)

*Primary Examiner* — Joshua G Kotis
*Assistant Examiner* — Scott A Howell
(74) *Attorney, Agent, or Firm* — The Webb Law Firm

(57) ABSTRACT

Described and depicted is an application apparatus for applying additional elements, in particular straws, to packages, preferably cardboard composite packages. So that the application can also be carried out reliably at high speeds and with moderate equipment complexity, it is provided that at least two applicators are provided which are adjustable along a common, circumferential transport track from a pick-up position for picking up the additional elements to an application position for applying the additional elements to the packages and back and which comprise respectively at least one application finger for pressing the additional elements onto the packages.

14 Claims, 8 Drawing Sheets

(51) Int. Cl.
*B65B 35/24* (2006.01)
*B65B 35/26* (2006.01)

(56) References Cited

U.S. PATENT DOCUMENTS

| | | | | |
|---|---|---|---|---|
| 4,372,797 | A * | 2/1983 | Dilot | B65B 61/205 156/249 |
| 4,384,915 | A | 5/1983 | Utsumi | |
| 4,605,459 | A | 8/1986 | Voltmer et al. | |
| 4,707,965 | A | 11/1987 | Becker | |
| 4,969,308 | A * | 11/1990 | Hakansson | B65B 61/205 53/133.1 |
| 6,282,865 | B1 | 9/2001 | Bergstrom et al. | |
| 6,526,725 | B1 | 3/2003 | Williams | |
| 7,762,043 | B2 | 7/2010 | Skarin et al. | |
| 7,770,712 | B2 * | 8/2010 | McCabe | B65G 29/00 198/698 |
| 8,647,459 | B2 | 2/2014 | Spatafora | |
| 9,475,657 | B2 * | 10/2016 | Bettinelli | A61F 13/15764 |
| 9,527,618 | B2 | 12/2016 | Wild et al. | |
| 9,751,171 | B2 * | 9/2017 | Mandler | B24B 13/0037 |
| 9,944,487 | B2 * | 4/2018 | McCabe | A61F 13/15764 |
| 10,640,252 | B2 * | 5/2020 | Zarur | B65B 61/205 |
| 2004/0242393 | A1 | 12/2004 | Cadieux, Jr. et al. | |
| 2010/0218456 | A1 | 9/2010 | Skarin et al. | |
| 2011/0002754 | A1 | 1/2011 | Spatafora | |
| 2013/0221589 | A1 * | 8/2013 | Mandler | B23Q 3/088 269/21 |
| 2016/0031654 | A1 * | 2/2016 | Bettinelli | B65G 29/00 198/377.01 |
| 2017/0327261 | A1 * | 11/2017 | Zarur | B65B 57/08 |
| 2018/0029737 | A1 | 2/2018 | Berglin et al. | |

FOREIGN PATENT DOCUMENTS

| | | | |
|---|---|---|---|
| CN | 101941541 | A | 1/2011 |
| DE | 2902899 | A1 | 8/1979 |
| DE | 3824013 | A1 | 1/1990 |
| EP | 0035645 | A1 | 9/1981 |
| EP | 0350590 | A1 | 1/1990 |
| EP | 1042172 | B1 | 4/2004 |
| JP | S5810294 | B2 | 2/1983 |
| JP | H0257534 | A | 2/1990 |
| JP | 2004168432 | A | 6/2004 |
| JP | 2007246172 | A | 9/2007 |
| JP | 2009525200 | A | 7/2009 |
| JP | 201111825 | A | 1/2011 |
| WO | 0238448 | A1 | 5/2002 |
| WO | 2016096379 | A1 | 6/2016 |

* cited by examiner

APPLICATION DEVICE, APPLICATION APPARATUS AND METHOD FOR APPLYING ADDITIONAL ELEMENTS TO PACKAGES

CROSS-REFERENCE TO RELATED APPLICATIONS

This application is the United States national phase of International Application No. PCT/EP2018/060338 filed Apr. 23, 2018, and claims priority to German Patent Application No. 10 2017 109 124.6 filed Apr. 27, 2017, the disclosures of which are hereby incorporated by reference in their entirety.

BACKGROUND OF THE INVENTION

Field of the Invention

The invention relates to an application apparatus for applying additional elements, in particular straws, to packages, preferably cardboard composite packages. The invention also relates to an application device for applying additional elements, in particular straws, to packages, preferably cardboard composite packages, having at least one transport device for transporting the packages along a package transport track. The invention further relates to a method for applying additional elements, in particular straws, to packages, preferably cardboard composite packages, preferably using the application apparatus of the above-mentioned type.

Description of Related Art

Packages are formed by packaging and the packaged good received therein. For example, bottles, tubular bags, cans, etc. may be possible packaging. The present packages are primarily composite packages, which are used as alternatives to bottles or cans. Corresponding packaging is mainly filled with the packaged good and sealed in a so-called filling machine, which for cardboard composite packages are often also referred to as forming/filling/sealing machines based on their main functions, specifically forming the packaging, filling the packaging and sealing the packaging.

Possible packaged goods are in particular flowable, i.e. liquid or at least pasty and, as required, can also contain lumpy parts. Dry and granulated packaged goods are not excluded, but do not play a significant role in practice. Often, foodstuffs are received in the packages, such as drinks, in particular milk, juices, nectars, dairy products and soups. In the case of drinks, cardboard composite packages are also referred to as drinks carton composite packages.

Composite packages are formed from interconnected packaging materials which form a sheet-like layer structure, the so-called packaging laminate. Cardboard composite packages have a cardboard layer, which gives the package stability and can serve as a carrier layer for the plastic layers arranged on both sides of the cardboard layer. Plastic layers serve as liquid barriers, for example. Thus, for example, the penetration of flowable products into the packaging laminate, in particular the cardboard layer, or even the leakage of flowable products is also avoided, as is the penetration of moisture from the outside. Furthermore, thermoplastic materials can be sealed to form firmly bonded sealing seams so as to form a packaging and seal the package. The packaging laminate may comprise further layers and packaging materials; for example an aluminium layer provides a barrier effect against gases and light. To be able to fold the sheet-like packaging laminate, i.e. to be able to fold it by machine, creases are often introduced into the packaging laminate which predefine the later fold lines. The folds form the package edges on the package and/or facilitate the shaping of the bottom and/or top of the package. Most packaging laminates are also printed with a decor.

The packaging laminate can be cut before forming the packaging, whereby so-called blanks are created. These may be further processed into so-called packaging casing blanks. For this purpose, the longitudinal edges are overlapped and sealed together to form a longitudinal sealing seam. A pipe-like casing or a so-called packaging casing blank or packaging sleeve is obtained in this way. Alternatively, the packaging laminate can be provided as continuous material, in particular as rolled goods, from which a packaging can be directly formed without first creating a blank.

Packages, such as those for foodstuffs, which can be designed as cardboard composite packages, are partially provided with additional components on the outer side, which for example can be designed as straws, which are also referred to as drinking straws, resealable spouts and/or opening elements, tear-off tabs, which are also referred to as pull tabs, labels or similar. For this purpose, special application devices are used which guide the packages with a transport device along a predetermined package transport track along the application device. The packages can thus be guided past an application apparatus for attaching the additional elements to the packages and as required guided through the application device. The application apparatus comprises an applicator which picks up the additional elements at a pick-up position and applies them successively to packages moved along the package transport track at an application position. Thus, the additional component is pressed into an adhesive provided on the package. However, alternatively, the adhesive can also be provided on the additional element. The adhesive then sets and the additional component remains permanently secured to the package until the user deliberately removes the additional component from the package, for instance to consume the drink provided in the package.

Corresponding application devices and methods are known for example from DE 29 02 899 A1 or EP 1 042 172 B1. These differ in that, among other things, attaching the additional elements is carried out on packages which are moved cyclically or continuously along the package transport track. Compared to a cyclical application of the additional elements, the application speed can also be increased in practice by a continuous application of additional elements only to a limited extent, without significantly increasing the likelihood of unforeseen disruptions. In addition, the constructive complexity for the application device and thus the equipment costs should not become too high.

The object of the present invention is therefore to design and refine the application apparatus, the application device and the method respectively of the type referred to at the outset and previously described in detail in such a way that the application can also be reliably carried out at high speeds and with moderate equipment complexity.

SUMMARY OF THE INVENTION

This object is achieved with an application apparatus, in that at least two applicators are provided which are adjustable along a common, circumferential transport track from a pick-up position for picking up the additional elements, to an application position for applying the additional elements to the packages and back and which comprise respectively at least one application finger for pressing the additional elements onto the packages.

The above-mentioned object is also achieved with an application device, in that an application apparatus according to as set forth above is provided for applying the additional elements to the packages transported along the package transport track.

The above-mentioned object is furthermore achieved by a method for applying additional elements, in particular straws, to packages, preferably cardboard composite packages, preferably using an application apparatus, in which the at least two applicators, preferably at least substantially uniformly distributed, are adjusted along a common, circumferential transport track from a pick-up position for picking up the additional elements to an application position for applying the additional elements to the packages and back, and in which the additional elements are pressed onto the packages in the application position respectively by at least one application finger of the applicators.

The invention has recognised that it is expedient to provide at least two applicators, which circulate along an in particular closed transport track and thus are adjustable from a pick-up position for picking up the additional elements to an application position for applying the additional elements to the packages and back. At first sight, this seems to be more complex in terms of design than the individual applicators from the prior art. However, it is not. The applicators can be moved circumferentially along a closed transport track at high speed without adversely affecting each other. On the other hand, a mere doubling of the oscillatingly driven applicators of the prior art would not only be technically complicated, but also highly likely to cause errors due to the mutual influence of the application arms.

The reliability of the application of the additional elements to the packages is ensured even at high application speeds by the fact that the applicators circulating around the closed transport track each comprise at least one application finger for pressing the additional elements onto the packages. Thus, not only is an application finger provided for applying the additional elements to the packages at the point of application, but at least two application fingers are provided which circulate around the closed transport track together with the applicators and thus are moved forward and back between the pick-up position and the application position along the transport track.

In the present case, packages are understood to mean, in particular, filled packages or containers, wherein the filling is preferably foodstuffs, in particular flowable foodstuffs. Such foodstuffs may be drinks, for example. For foodstuffs, in particular drinks, additional elements such as straws have particular significance.

In principle, the packages can be made of different materials, such as plastic. However, the installation of additional elements to cardboard composite packages is particularly expedient and desired by customers. These involve packages made of a packaging material in the form of a laminate, which may have a cardboard layer and outer plastic layers, in particular thermoplastic layers, for example made of polyethylene (PE). The cardboard confers sufficient stability to the packages, so that the packages can be easily handled and for example stacked. The plastic layers protect the cardboard from moisture and the foodstuffs from the absorption of undesired substances from the package. In addition, further layers can be provided, such as an aluminium layer, which prevents a diffusion of oxygen and other gases through the packaging material. If necessary, however, other composite packages made of differently constructed packaging materials would also be suitable.

In the production of corresponding cardboard plastic composite packages, packages which are initially open on one side are typically formed from the packaging material and then filled and sealed. The finished packages can then be provided immediately afterwards or in a separate process decoupled from the filling with at least one additional element.

Regardless of the type of package, additional elements in particular relate to straws, which may be packaged separately for reasons of hygiene. For the sake of simplicity, plastic films are suitable for packaging. So-called blister packs are particularly preferred for this purpose. These are usually transparent packages that reveal the wrapped straw. The straws or other additional elements are then sealed between two plastic films, for example. Straws attached to the packages make it possible to easily consume drinks on the go and without the risk of spilling the drink.

However, instead of straws or wrapped straws, spouts or closures can also be arranged as additional elements on the packages. The packages can then be easily unscrewed, opened and/or poured, which makes it easier to consume the packaged foodstuff. However, additional components of the foodstuff can also be provided as additional components on the packages, which, for example, are mixed with the other foodstuff just before consumption. In particular, flavours, vitamins, lumpy portions or the like are referred to here. It is also conceivable that the packages are provided with customer information or advertisements in the form of additional elements. These can be slips of paper or small brochures. It is also possible to arrange giveaways or marketing products such as toys or similar as additional elements on the packages.

For ease of understanding and to avoid unnecessary repetitions, the application apparatus, the application device and the method for applying additional elements are described together in the following, without distinguishing in each case in detail between the application apparatus, the application device and the method. However, it will be apparent to the person skilled in the art, given the context, which feature is preferred with respect to the application apparatus, the application device and the method.

In a first particularly preferred embodiment of the application apparatus, the at least two applicators are distributed uniformly over the circumferential transport track. This simplifies the control of the method and also simplifies its implementation, which can therefore be made more uniform. In particular, packages which are transported past the application apparatus at uniform spatial and temporal intervals can thus be simply provided with additional elements.

For a simplification of the method, but in particular the equipment complexity, the closed circumferential transport track may be formed as a circular track. The applicators can then be fixed, for example, in a particularly simple manner on an application wheel rotating about a positioning axis of rotation and/or on an application carousel rotating about a positioning axis of rotation. By rotating the applicators, the applicators are positioned, for example, in the pick-up position and/or the application position. This can be realised constructively in a simple manner and allows a simple method control even at high application speeds.

In order to increase the reliability of the transport of the additional elements from the pick-up point by the applicators to the point of application of the additional elements to the packages, it may be expedient if the application finger is designed for at least partially receiving and/or holding the additional elements. For this purpose, the application fingers can have a recess, for example in the form of a hollow or depression, in which an additional element can be received at least in regions or in which an additional element can engage.

The reliability of the application of the additional elements to the packages can alternatively or additionally be improved in that the applicators each have a base against which the at least one application finger is pivotably arranged. For reasons of simplicity and reliability, the application finger is pivotably mounted on the applicator about a pivoting axis. It is particularly expedient if the application finger can be pivoted in the application position of the associated applicator in the direction of the packages in order to be able to press the additional elements onto the packages during the application of the additional elements. If the additional elements and the packages are guided precisely and with exact positioning, a minimal pivotability of the application fingers with respect to the base of the applicators may be already sufficient here. Alternatively or additionally, the pivotability of the application fingers can be provided in the pick-up position of the applicators and used to receive the additional elements to a greater extent in the applicators. For this or another purpose, the application finger may preferably be pivoted inwards in relation to the closed circumferential transport track about the pivoting axis. During application or thereafter, the application finger can then be pivoted back as required, so that, in the pick-up position or before, the applicator can always take up a starting position again.

In order to be able to transport and guide the additional elements from the pick-up position to the application position at least in sections precisely and in a defined manner, it is advisable to use an additional element guide. The additional element guide can be designed and arranged so that the additional elements, at least in sections, come into contact with the additional element guide between the pick-up position and the application position. To ensure this contact and the defined transport of the additional elements along the additional element guide, which can also ensure that the additional elements do not accidentally come out of engagement with the applicators, the applicators, in particular the application fingers, press the additional elements onto the additional element guide, while the additional elements slide along the additional element guide.

The functionality of the application finger can be particularly expediently achieved if the application finger is spring-loaded and/or preloaded. A spring-loaded application finger can thus be adjusted against the restoring force of at least one spring means, while the preloading means that a force, such as a restoring force, acts on the application finger, with the aim to adjust the application finger. In this connection, it is particularly preferred if a spring-loaded application finger is preloaded at least in regions or temporarily. By means of the spring loading and/or the preloading, for example, the additional element can then be held, pressed onto the additional element guide and/or pressed onto a package.

If the applicators adjacent to the application finger comprise a guide finger for guiding in an interlocking manner the additional element held at least partially by the application finger, the additional element can be guided even more reliably in the transport direction in the direction of the application position. As required, the additional element can also be guided at least in regions by the application finger and the guide finger. In this case, the additional element can rest in an interlocking manner on both the application finger and on the guide finger. Alternatively or additionally, the guide finger can prevent the additional element from accidentally slipping from the application finger and, if necessary, only then come into action to guide the additional element.

In order to ensure a simple and reliable pick-up of the additional elements by the applicators and at the same time to allow application of the additional elements in a suitable relative orientation with respect to the packages, the applicators can each be designed pivotable about an orientation pivoting axis from a pick-up orientation to an application orientation and back. In order to achieve a precise adjustment of the orientation of the applicators and/or additional elements independently of the adjustment of the applicators along the closed circumferential transport track, even if both adjustment movements overlap one another, it is expedient if the orientation pivoting axes of the applicators are oriented with respect to the positioning axis of rotation of the application wheel and/or the application carousel. This is particularly the case when the positioning axis of rotation of the application wheel and/or application carousel is oriented perpendicular to the orientation pivoting axis. The adjusting movements can then be easily and independently from one another adapted to changing requirements.

Method-wise, it is particularly simple if the applicators rotate around a circular track. Then, the method of application is overall simple to control. In addition, the application speed can be easily adjusted and controlled. In terms of equipment and method-wise, this is particularly the case when the applicators are arranged on a rotating application wheel and/or application carousel.

If when picking up the additional elements from the applicators an application finger is adjusted against a restoring force, in particular pivoted, this forced adjustment can be used to hold, guide and/or apply the additional elements at least in sections in a more reliable and precise manner between the pick-up position and the application position as a result of the restoring force. Thus, the additional elements can, for example, at least in sections, be held between the pick-up position and the application position, in particular in a recess, by a spring-loaded and/or preloaded application finger. Alternatively or additionally, the additional elements can at least in sections be pressed between the pick-up position and the application position against an additional element guide for guiding the additional elements by a spring-loaded and/or preloaded application finger. However, the additional elements can alternatively or additionally also be pressed against the packages by a spring-loaded and/or preloaded application finger in the application position.

In order to be able to ensure a precise and exact transport of the additional elements even at high application speeds, it may be advisable to guide and/or hold the additional elements at least in sections between the pick-up position and the application position adjacent to the application finger by a guide finger. Accidental and considerable slipping of the additional element relative to the application finger during the transport of the additional element from the pick-up position to the application position can thus be avoided.

If the applicators between the pick-up position and the application position are each pivoted about an orientation pivoting axis from a pick-up orientation to an application orientation, the additional elements can be easily and reliably picked up in a suitable orientation by the applicators and applied to the packages in another orientation suitable for the application. In order to be able to easily adapt the orientation of the additional elements in the pick-up position and the application position to different requirements and to be able to ensure reliable operation, it is particularly preferred if the applicators are pivoted about the orientation pivoting axis at least substantially perpendicular to the positioning axis of rotation of the application wheel and/or application carousel.

BRIEF DESCRIPTION OF THE DRAWINGS

The invention will subsequently be explained in more detail with reference to a drawing depicting two exemplary embodiments, wherein.

DESCRIPTION OF THE INVENTION

Figure 1:
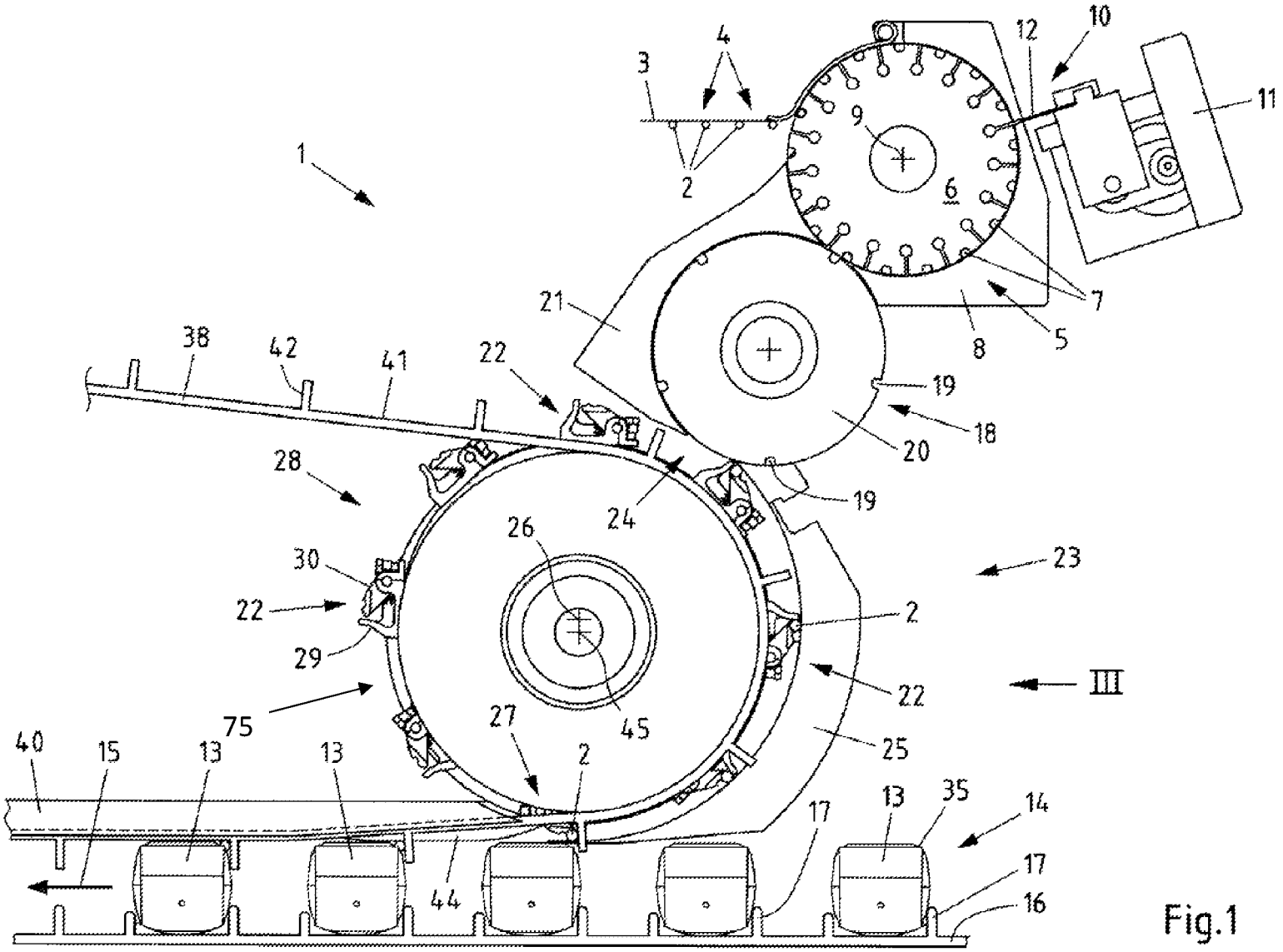
FIG. 1 shows a first application device according to the invention in a schematic top view.

In FIG. 1, an application device 1 for applying additional elements 2 in the form of straws is depicted. The application device 1 is supplied with a belt 3 made of two sealed-together, in particular transparent, plastic films, between which straws are provided at regular intervals. Accordingly, the belt 3 is formed by an interconnected series of blister packs 4 and drawn in by a supply device 5 which comprises a supply carousel 6 having recesses 7 distributed over the circumference and a belt guide 8 arranged at least partially around the supply carousel 6. The supply carousel 6 rotates about a central positioning axis of rotation 9 in a stepwise manner in a clockwise direction. With each rotation step, a further additional element 2 is received in a recess 7 of the supply carousel 6 and an additional element is also cut and separated from the belt 3 in a cutting position 10 by a separating device 11 by means of a cutting blade 12.

Each straw, together with the plastic films, between which the straws are respectively sealed, forms an additional element 2 which is provided for application on a package 13. The corresponding packages 13 are transported at another point of the application device 1 by a transport device 14 successively along a package transport track 15 or through the application device 1. For this purpose, the transport device 14 comprises a transportation belt 16 with a series of cams 17 which extend in the direction of the package transport track 15 of the packages 13.

After further rotation steps, the separated additional elements 2 are relayed to a delivery device 18 from the supply carousel 6 of the supply device 5. The individual additional elements 2 each pass into a recess 19 of a delivery wheel 20, which turns in a swelling manner, i.e. with repeatedly varying speed, in an anti-clockwise direction and cooperates in sections with a radially adjacent delivery guide 21 to hold the additional elements 2 in the recesses 19 and thus to accelerate each additional element 2 from standstill when picked up to the circumferential speed of applicators 22 of an application apparatus 23 driven continuously at an at least substantially constant speed when relaying the additional elements 2. The applicators 22 pick up the additional elements 2 in a pick-up position 24 from the delivery wheel 20. Then, the additional elements 2 are moved between the corresponding applicator 22 and an additional element guide 25 in the direction of the packages 13. In this case, the applicator 22 reaches the application position 27, in which the applicator 22 delivers or applies the associated additional element 2 to the package 13 transported along the package transport track 15 past the application position 27 of the applicator 22, in particular to the side surface facing the applicator 22 in the application position 27.

So that the additional element 2 remains securely held on the package 13, the package 13 has previously been provided with adhesive, against which the additional element is pressed. However, alternatively or additionally, the additional element 2 could be provided with an adhesive, for example, immediately before the application of the additional element 2 or even before supplying the additional elements 2 in the form of the belt 3.

Figure 2:
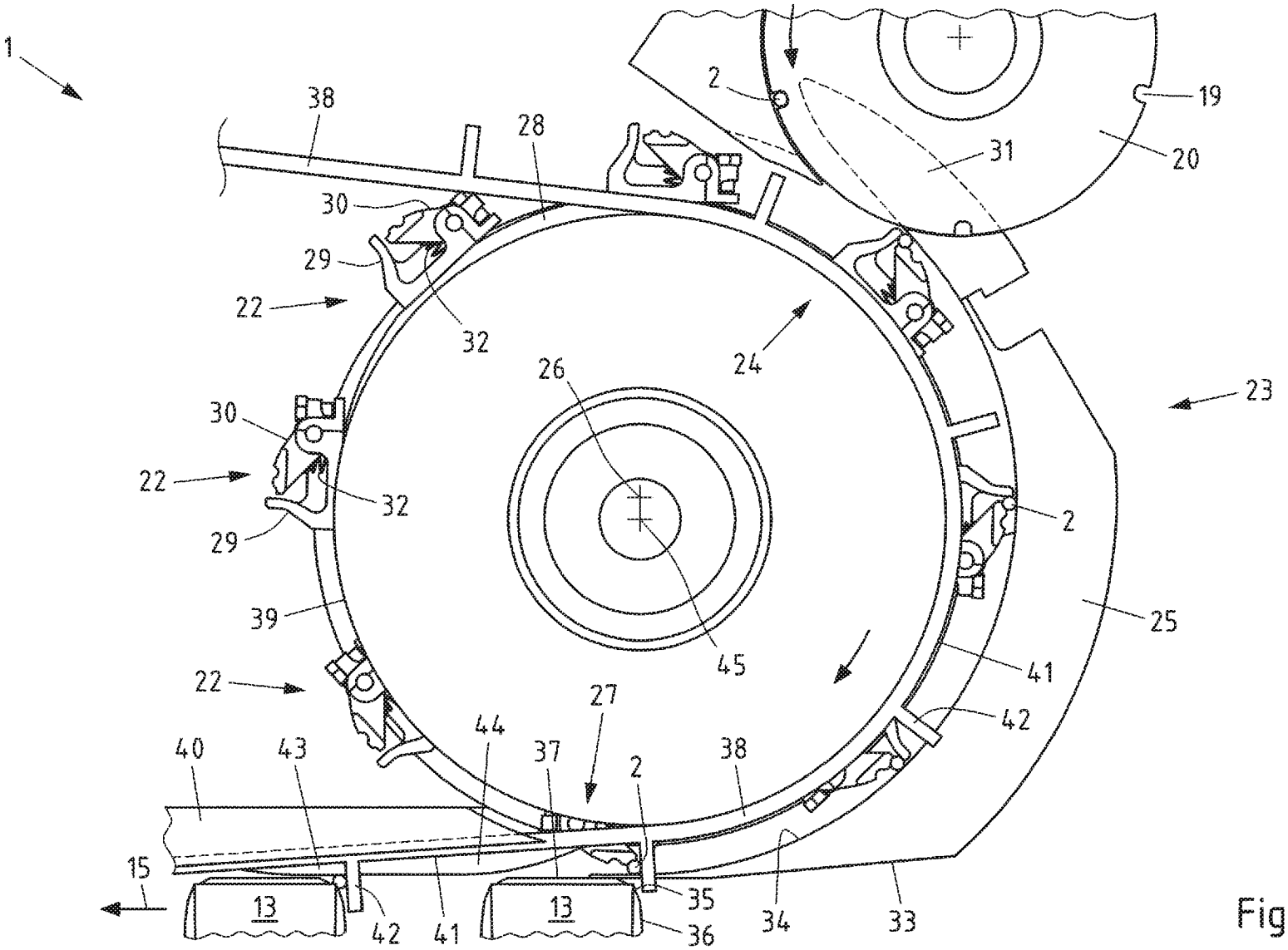
FIG. 2 shows a detail of the application device from FIG. 1 comprising a first application apparatus according to the invention in a schematic top view.

FIG. 2 shows a detail of the application device 1 comprising the application apparatus 23 having the applicators 22 for applying the additional elements 2 to the packages 13. The additional elements 2 are transported with the applicators 22 on the additional element guide 25 along an arc-shaped section to the packages 13 or the application position 27 of the applicators 22. The depicted and insofar preferred application apparatus 23 comprises an applicator wheel 28 comprising applicators, which can be considered here as part of an applicator carousel. The applicator wheel 28 preferably rotates continuously in a clockwise direction about a positioning axis of rotation 26. Subsequently, the provided applicators 22 are moved continuously and circularly about the positioning axis of rotation 26 of the applicator wheel 28. As shown in FIG. 1, at least two applicators 22 are provided which are adjustable along a common, circumferential transport path 75 from a pick-up position for picking up the additional elements 2 to an application position for applying the additional elements 2 to the packages 13 and back.

The applicators 22 comprise a guide finger 29 and an application finger 30 which engage in the delivery wheel 20 and pick up the additional elements 2 from said delivery wheel. For this purpose, the additional elements 2 are moved out of the delivery wheel 20 by interlocking contact with a relay device 31 engaging in the delivery wheel 20 and moved in the pick-up position 24 into an adjacent applicator 22. The guide finger 29 is arranged fixed on the depicted and insofar preferred applicators 22. The guide finger 29 holds and guides the additional elements 2 during their transport from the pick-up position 24 and the application position 27. The additional elements 2 are thus also held by the application finger 30, in particular at least partially received in a recess of an application finger 30. The application finger 30 holds the additional element 2 in contact with the additional element guide 25 extending between the pick-up position 24 and the application position 27. The application finger 30 is spring-loaded or preloaded against the additional element guide 25 so that the guide finger 30 presses the additional elements 2 outwards against the additional element guide 25 to ensure a defined and reliable transport of the additional elements 2 from the pick-up position 24 to the application position 27. Thus, the application finger 30 is held pivotably on the applicator 22 against the restoring force of a spring means 32 in the direction of the positioning axis of rotation 26.

The additional element guide 25 ends on or just before the application position 27 of the applicators 22, at which the application fingers 30 press or apply the additional elements 2 to the packages 13. The packages 13 are guided past the application position 27 of the applicators 22 at a speed which at least substantially corresponds to the circumferential speed of the applicators 22, in particular the transport speed of the additional elements 2. Before the application of the additional elements 2, the packages 13 are also in contact with the additional element guide 25, but on an outer guide surface 33 and not on an inner guide surface 34 like the additional elements 2 of the additional element guide 25. Thus, the additional elements 2 and the packages 13 are oriented to one another via the guide surfaces 33, 34 of the additional element guide 25 before the delivery or the application of the additional elements 2 to the packages 13.

The packages 13 to be provided with additional elements 2 comprise bevelled edge regions 35, which are both inclined towards the adjacent side surfaces 36, 37 of the package 2 and also towards the transport track 15 of the packages 13. The application finger 30 presses the additional elements 2 in the application position 27 onto a rear edge section 35 of the package 13. Subsequently, the additional elements 2 are held in the corresponding position by positioning belts 38 until an adhesive bond is established between the package 13 and the additional element 2.

In FIG. 2, the positioning belts 38 are arranged overlapping one another so that only one of the positioning belts 38 is depicted. The positioning belts 38 are designed as a continuous belt which continuously circulates about deflections 39. Thus, the positioning belts 38 in the depicted and insofar preferred application device 1 are gradually approached towards the transport track 15 of the packages 13 and therefore the packages 13 themselves via a guide device 40. The positioning belts 38 also respectively comprise holding cams 42 protruding from the belt section 41 in the direction of the packages 13 or the direction of the transport track 15 of the packages 13. The holding cams 42 are approached from the side and from the rear in the transport direction of the packages 13 to the rear side of the packages 13 seen in the transport direction of the packages 13. The belt section 41, respectively one holding cam 42 and one package 13 thus form a receiving space 43 in the edge region 35 of the respective package 13 for receiving the additional elements 2. The additional elements 2 are in this way held on the packages 13 and pressed onto the packages 13.

A comb device 44 is provided in the depicted and insofar preferred application device 1. The comb device 44 is spaced apart from the additional element guide 25 so that the applicators 22 can apply the additional elements 2 to the packages 13 in the intermediate space between the additional element guide 25 and the comb device 44. The additional elements 2 come in the transport direction of the packages 13 into contact with the comb device 44 and are thus guided into the receiving spaces 43 between the packages 13 and the positioning belts 38, to be pressed from the positioning belts 38 onto the package 13.

In the region of the application position 27 of the additional elements 2 on the packages 13, the positioning belts 38 are deflected about a deflection 39 which rotates about an axis of rotation 45. This axis of rotation 45 is spaced apart from the positioning axis of rotation 26 of the applicator wheel 23 in the direction of the application position 27 of the additional elements 2 to the packages 13. However, the axes of rotation 26, 44 are aligned at least substantially in parallel to one another. The holding cams 42 thus neither impede the guiding of the additional elements 2 to the packages 13 nor the actual application of the additional elements 2 by the applicators 22. Rather, the holding cams 42 are slowly guided to the additional elements 2 so that the holding cams 42 only come into contact with the additional elements 2 when the additional elements 2 are applied to the packages 13.

Figure 3:
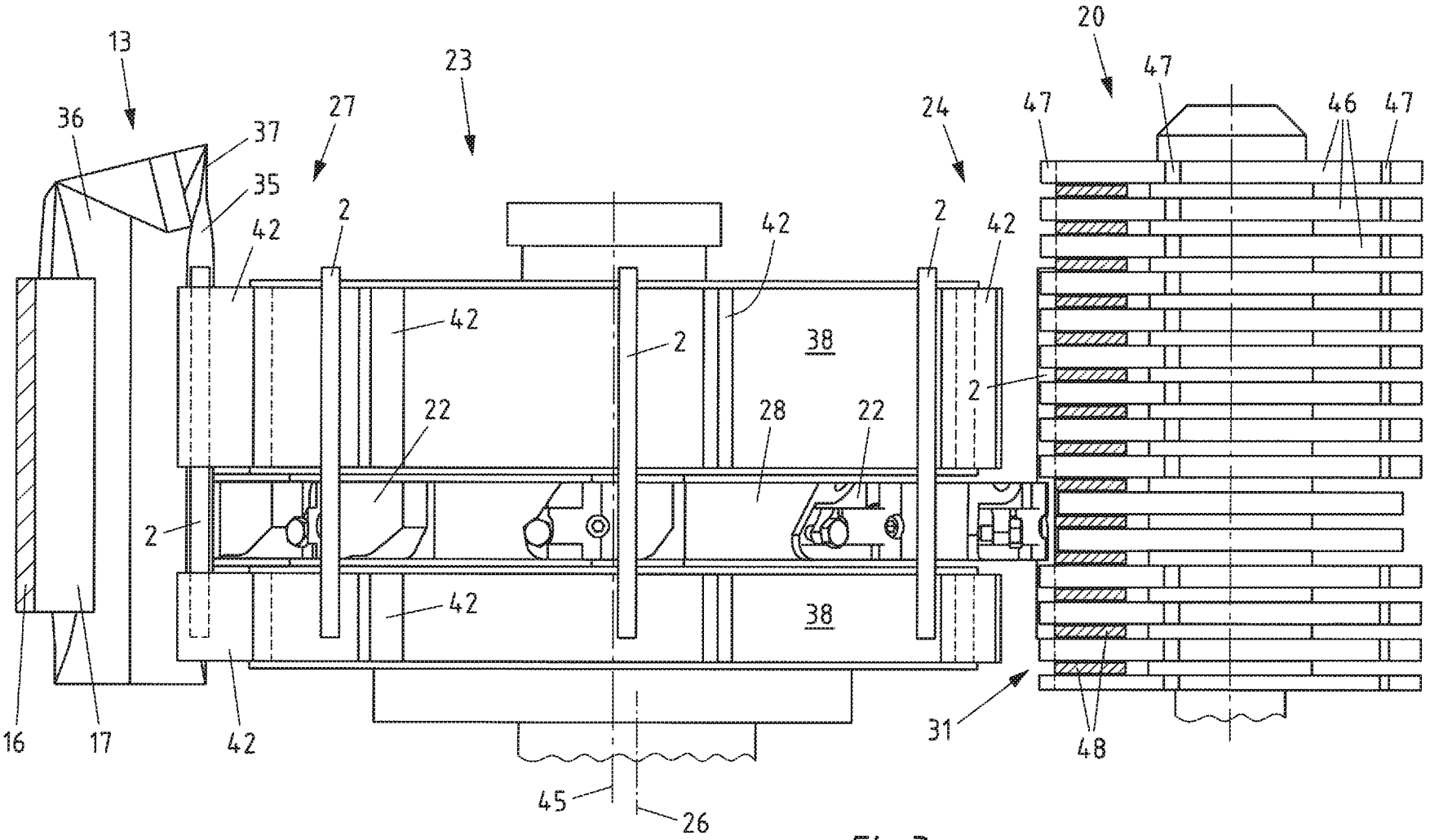
FIG. 3 shows a detail of the application device from FIG. 1 in a schematic side view.

FIG. 3 shows a detail of the application device 1 comprising the application apparatus 23 in a side view, from which the transport of the additional elements 2 from the pick-up position 24 of the applicators 22 to the application position 27 of the applicators 22 and the application of the additional elements 2 to the packages 13 transported past the applicator wheel 23 along the package transport track 15 by means of the transportation belt 16 can be seen. The delivery wheel 20 has spaced-apart discs 46, which provide recesses 47 for the additional elements 2. Relay fingers 48 of the relay device 31 engage between the discs 46 of the delivery wheel 20. The additional elements 2 are accelerated by the delivery wheel 20 after the delivery of the next additional element 2 until the speed of the additional elements 2 corresponds to the speed of the applicators 22 during the pick-up of the additional elements 2 by the applicators 22 in the pick-up position 24. Before relaying the additional elements 2 from the delivery wheel 20 to the application apparatus 23, the additional elements 2 come into contact with the relay fingers 48 of the relay device 31 engaging between the discs 46 of the delivery wheel 20. On the relay fingers 48, the additional elements 2 slide outwards in the direction of an adjacent applicator 22, from which the additional elements 2 are picked up.

Figure 4:
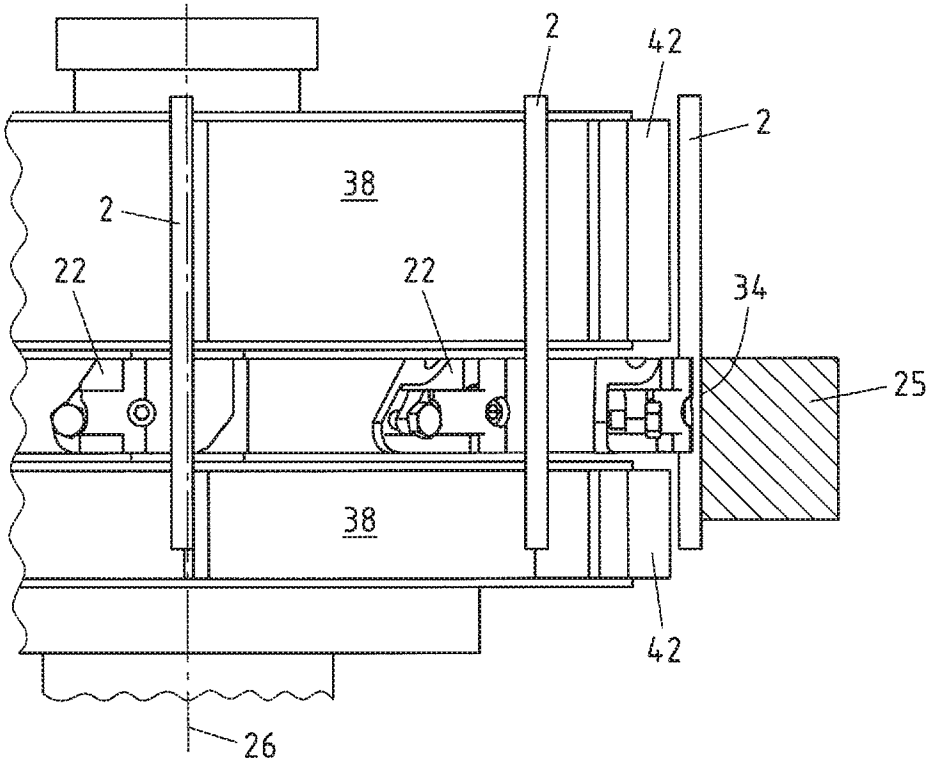
FIG. 4 shows a further detail of the application device from FIG. 1 in a schematic side view.

In this case, the additional element 2 presses the application finger 30 against the spring means 32 inwards and is guided by the guide finger 29 at the same time. The application finger 30 presses the additional element 2 from the inside to the outside against the adjacent additional element guide 25. The additional element guide 25 extends substantially from the pick-up position 24 to the application position 27 of the applicators 22. This can be seen in particular in the detail in FIG. 4. The additional element 2 is held in contact with the additional element guide 25 and thus slides on the inner guide surface 34 of the additional element guide 25.

However, in FIG. 3, the delivery and application of the additional elements 2 to the packages 13 are depicted. The application fingers 30 of the applicators 22 press the additional elements 2, if only lightly, onto the packages 13 so that these adhere to the packages 13 via the adhesive. As the bond is initially very weak, the additional elements 2 are then held to the packages 13 by the comb sheet 44 and the positioning belts 38, so that the adhesive can set, in particular by air drying. The positioning belts 38 are provided above and below the applicator wheel 28, over which the applicators 22 distributed circumferentially at uniform intervals rotate along a circular track about the positioning axis of rotation 26.

Figure 5A:
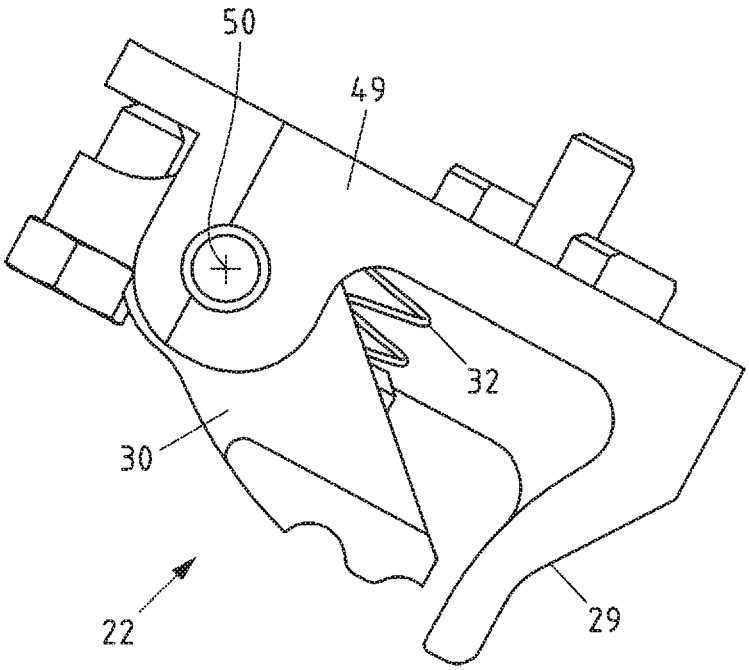
FIGS. 5A-B show an applicator of the application apparatus from FIG. 2 in a top view and a perspective view.
Figure 5B:
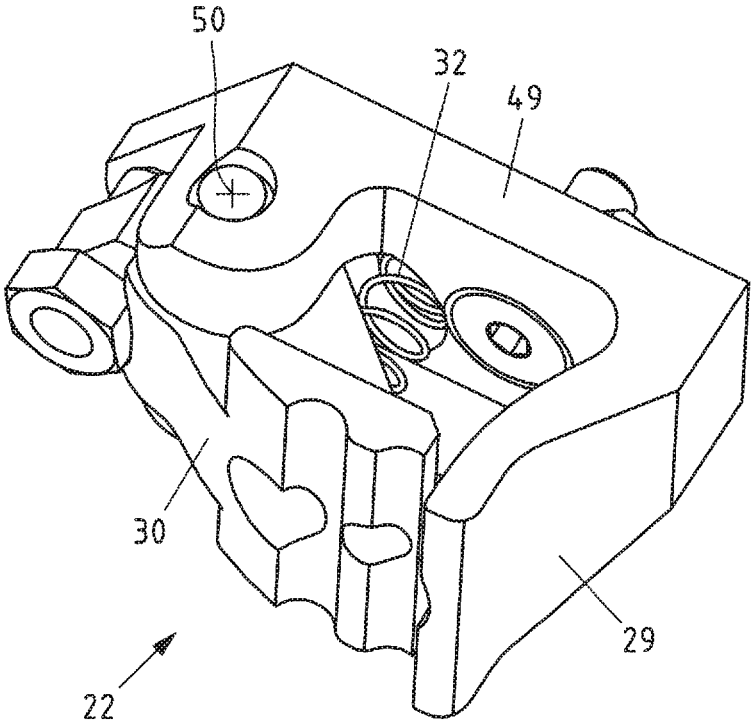

An applicator 22 is shown from different perspectives in FIGS. 5A-B. The applicators 22 comprise a base 49 with which the applicators 22 are secured to the applicator wheel 23. The guide finger 29 extends outwards in relation to the base 49. The application finger 30 is provided adjacent to the guide finger 29, which application finger is pivotably secured on the base 49 of the applicator 22 about a pivoting axis 50. In addition, a spring means 32 is provided between the base 49 and the application finger 30, which spring means provides the pivoting of the application finger 30 to an outer position as long as the application finger 30 is not blocked by an interlocking. This is the case if the applicator 22 holds an additional element 2 and the application finger 30 presses the additional element 2 outwards against the additional element guide 25.

Figure 6:
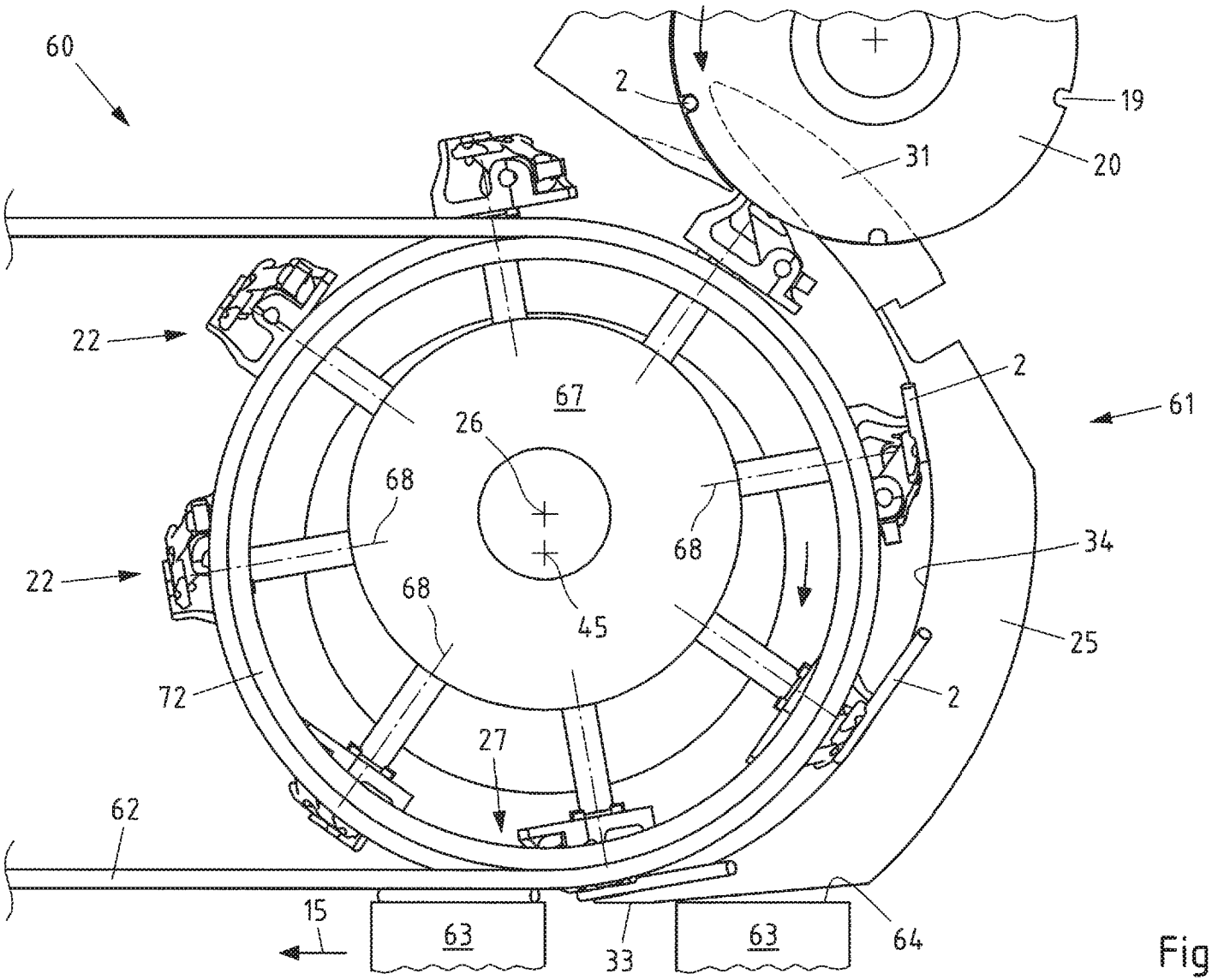
FIG. 6 shows a detail of a second application device according to the invention comprising a second application apparatus according to the invention in a schematic top view.

A detail of an alternative application device 60 with an alternative application apparatus 61 is shown in FIG. 6. These correspond in many parts to the application device 1 and the application apparatus 23 according to FIG. 1. Therefore, the same reference signs are used for the same components and only certain components are described again. A substantial difference from the application device 1 of FIG. 1 is that only one positioning belt 62 is provided and that this positioning belt 62 does not require a holding cam. This is due to the fact that, with the depicted and insofar preferred application device 60, additional elements 2 are applied to cuboid packages 63, on a side surface 64 of the packages 63, which are oriented at least substantially parallel to the transport track 15 of the packages 63 in the application position 27 of the applicators 22.

The additional elements 2 are held by the applicators 22 and guided along an additional element guide 25 in a arc-shaped track to the application position 27 or the packages 63. At the end of the additional element guide 25, the additional elements 2 are guided from the additional element guide 25 as shown in FIG. 8 at an inner guide surface 34 and the packages 63 are guided at an outer guide surface 33, on which the packages 63 slide along and thus are oriented correspondingly to the additional elements 2. The additional elements 2 then directly arrive from the additional element guide 25 in the application position 27 of the applicators 22 on the packages 63. During this the applicators 22 press the additional elements 2 by means of the spring-loaded application finger 30 onto the packages 63, which are provided with an adhesive at corresponding points. With this delivery of the additional elements 2, the positioning belt 62 is brought into contact with the additional elements 2 and is moved at the same speed and in the same direction as the packages 63. The packages 63 are transported by a transportation belt 65, depicted in FIG. 7, along a transport track 15, in which each package 63 is in interlocking engagement with a cam 66.

Figure 7:
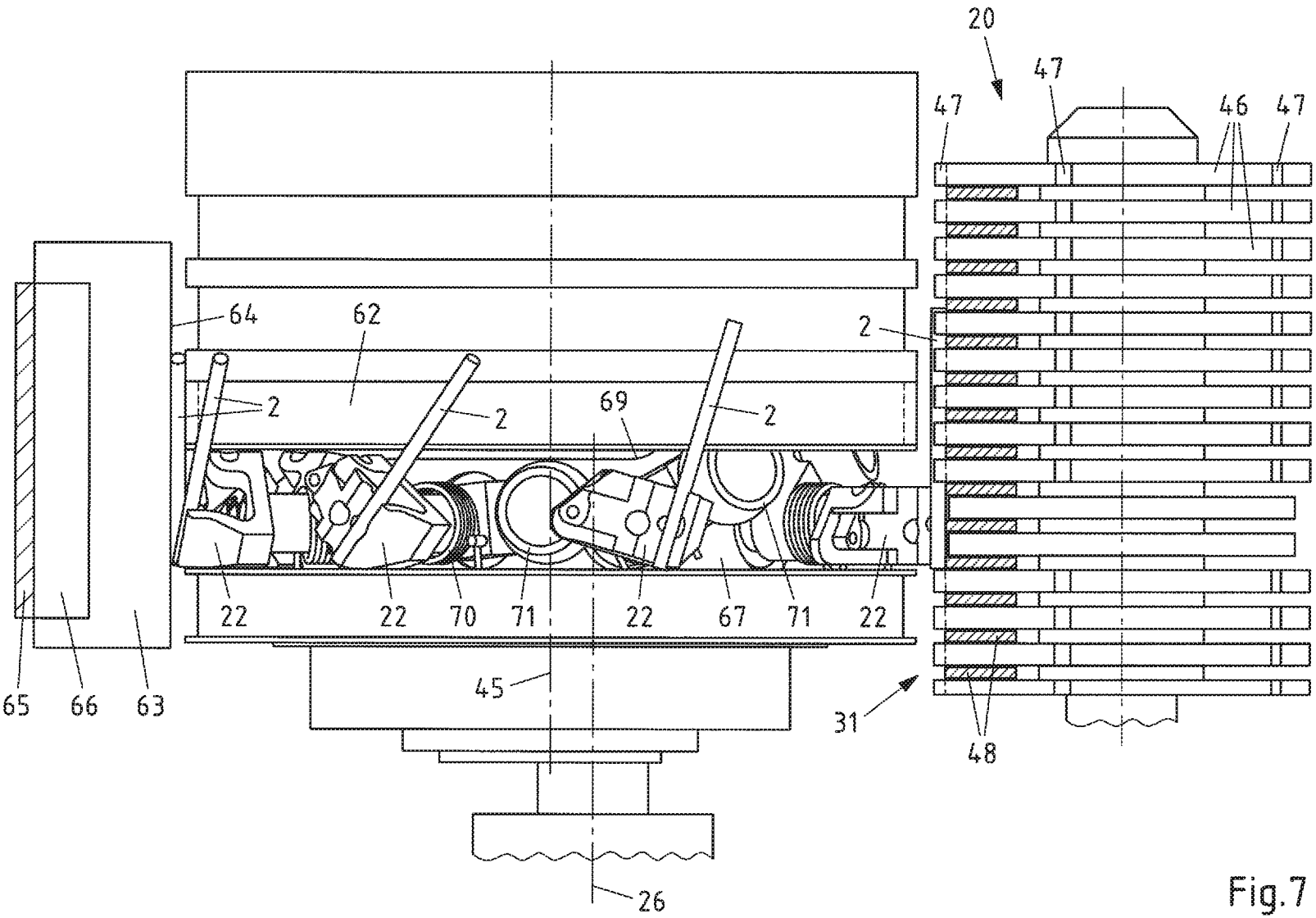
FIG. 7 shows a detail of the application device from FIG. 6 in a schematic side view.
Figure 8:
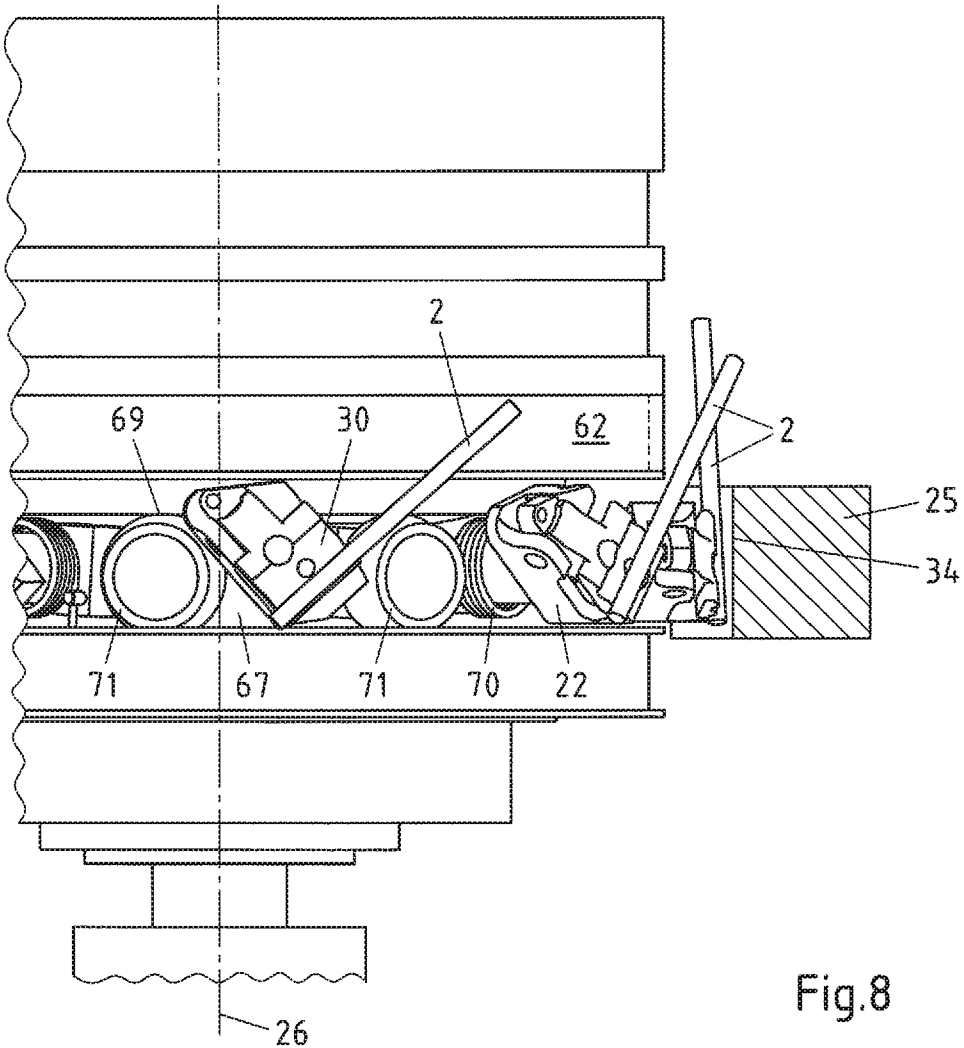
FIG. 8 shows a further detail of the application device from FIG. 6 in a schematic side view.

In FIG. 7, the application apparatus 61 is depicted in a side view analogous to FIG. 3. Similar to the application apparatus 23 according to FIG. 3, the applicators 22 are combined to form an applicator wheel 67 rotating about a positioning axis of rotation 26. In contrast to the applicator wheel 23 of FIG. 1, the applicators 22 are pivoted about an orientation pivoting axis 68 when rotating about the positioning axis of rotation 26.

For simultaneous rotation of the applicators 22 about the positioning axis of rotation 26 and pivoting about the orientation pivoting axis 68, the application device 61 is provided with a control cam 69. Rollers 71 rotate on the control cam 69 engaged via spring means 70, which rollers are in doing so adjusted up and down parallel to the positioning axis of rotation 26. This adjustment of the rollers 71 is converted via a lever means into a pivoting of the applicators 22 about the pivoting axis 68. Cam discs having similar control cams 69 are generally known from the prior art.

By pivoting the applicators 22 about the orientation pivoting axis 68, the additional elements 2 can be picked up by the applicators 22 in a pick-up orientation parallel to the positioning axis of rotation 26 of the application wheel 67 and applied to the packages 63 in an application orientation inclined in relation to the positioning axis of rotation 26. The additional elements 2 can thus be applied diagonally to the corresponding side surface 64 of the package 63. Thus, additional elements 2, in particular straws, can be applied which are longer than the height of the package 63 without problems.

The positioning belt 62 circulates about a deflection 72, which also rotates about an axis of rotation 45, wherein this axis of rotation 45 is offset in relation to the positioning axis of rotation 26 of the applicator wheel 67 in the direction of the packages 63 or the application position 27 of the applicators 22. In this way, and due to the radius of the deflection 72, a gap tapering in the direction of the application position 27 of the applicators 22 is provided between the additional element guide 25 and the positioning belt 62, which gap corresponds at least substantially to the width of the additional elements 2 in the application position 27 of the applicators 22 so that the additional elements 2 are from the application position 27, in which the additional elements 2 are pressed by the application fingers 30 onto the packages 63 to provide a still weak adhesive bond, held by the positioning belt 62 on the packages 63. This is carried out until the adhesive has set.

LIST OF REFERENCE SIGNS

1 Application device
2 Additional elements
3 Belt
4 Blister pack
5 Supply device
6 Supply carousel
7 Recesses
8 Belt guide
9 Positioning axis of rotation
10 Cutting position
11 Separating device
12 Cutting blade
13 Package
14 Transport device
15 Package transport track
16 Transportation belt
17 Cams
18 Delivery device
19 Recess
20 Delivery wheel
21 Delivery guide
22 Applicators
23 Applicator device
24 Pick-up position
25 Additional element guide
26 Positioning axis of rotation
27 Application position
28 Applicator wheel
29 Guide finger
30 Application finger
31 Relay device
32 Spring means
33 Outer guide surface
34 Inner guide surface
35 Edge region
36 Side surface
37 Side surface
38 Positioning belt
39 Deflection
40 Guide device

41 Belt section
42 Holding cam
43 Receiving space
44 Comb device
45 Axis of rotation
46 Disc
47 Recess
48 Relay finger
49 Base
50 Pivoting axis
60 Application device
61 Application apparatus
62 Positioning belt
63 Package
64 Side surface
65 Transportation belt
66 Cams
67 Applicator wheel
68 Orientation pivoting axis
69 Control cam
70 Spring means
71 Roller
72 Deflection

The invention claimed is:

1. An application apparatus for applying additional elements to packages, wherein at least two applicators are provided which are adjustable along a common, circumferential transport path from a pick-up position for picking up the additional elements to an application position for applying the additional elements to the packages and back and which comprise respectively at least one application finger for pressing the additional elements onto the packages, wherein the at least two applicators respectively comprise a base and wherein the at least one application finger of the at least two applicators is provided so as to be pivotable about a pivoting axis relative to the base such that the at least one application finger of the at least two applicators is pivotable in the application position of an associated applicator in the direction of the packages, wherein the at least two applicators each include a guide finger formed with the base and extends from the base and adjacent to the respective at least one application finger, in which the guide finger and the at least one application finger extend from opposing ends of the base, an additional element guide is provided for guiding the additional elements and for contacting the additional elements with the additional element guide respectively at least partially between the pick-up position and the application position, and wherein the additional element guide comprises at least an inner guide surface and an outer guide surface provided to orient the additional elements and the packages relative to one another.

2. The application apparatus according to claim 1, wherein the at least two applicators are distributed uniformly over the circumferential transport path.

3. The application apparatus according to claim 1, wherein the at least two applicators are secured to an application wheel and/or application carousel rotating about a positioning axis of rotation.

4. The application apparatus according to claim 1, wherein the at least one application finger is designed for at least receiving and/or holding the additional elements.

5. The application apparatus according to claim 1, wherein the at least one application finger of the at least two applicators are provided for pressing the additional elements onto the additional element guide.

6. The application apparatus according to claim 1, wherein the at least one application finger is spring-loaded, preloaded, or spring-loaded and preloaded for at least one of the following: holding the additional elements, for pressing the additional elements onto the additional element guide, and for pressing the additional elements onto the packages.

7. The application apparatus according to claim 1, wherein the guide finger is configured for guiding in an interlocking manner the additional elements at least held by the at least one application finger in the transport device of the additional elements.

8. The application apparatus according to claim 1, wherein the at least two applicators are respectively pivotable about an orientation pivoting axis from a pick-up orientation to an application orientation and back, and in that the orientation pivoting axes of the at least two applicators are oriented inclined to the positioning axis of rotation of the application wheel and/or application carousel.

9. An application device for applying additional elements to packages, having at least one transport apparatus for transporting the packages along a package transport path, wherein an application apparatus is provided for applying the additional elements to the packages transported along the package transport path, wherein the application apparatus comprises:

at least two applicators are provided which are adjustable along a common, circumferential transport path from a pick-up position for picking up the additional elements to an application position for applying the additional elements to the packages and back and which comprise respectively at least one application finger for pressing the additional elements onto the packages, wherein the at least two applicators respectively comprise a base and wherein the at least one application finger of the at least two applicators is provided so as to be pivotable about a pivoting axis relative to the base such that the at least one application finger of the at least two applicators is pivotable in the application position of an associated applicator in the direction of the packages, wherein the at least two applicators each include a guide finger formed with the base and extends from the base and adjacent to the respective at least one application finger, in which the guide finger and the at least one application finger extend from opposing ends of the base, wherein an additional element guide is provided for guiding the additional elements and for contacting the additional elements with the additional element guide respectively at least partially between the pick-up position and the application position, and wherein the additional element guide comprises at least an inner guide surface and an outer guide surface provided to orient the additional elements and the packages relative to one another.

10. A method for applying additional elements to packages, with an application apparatus comprising:

at least two applicators are provided which are adjustable along a common, circumferential transport path from a pick-up position for picking up the additional elements to an application position for applying the additional elements to the packages and back and which comprise respectively at least one application finger for pressing the additional elements onto the packages, wherein the at least two applicators respectively comprise a base and wherein the at least one application finger of the at least two applicators is provided so as to be pivotable about a pivoting axis relative to the base such that the at least one application finger of the at least two applicators is pivotable in the application position of an associated applicator in the direction of the packages, wherein an additional element guide is provided for guiding the additional elements and for contacting the additional elements with the additional element guide respectively at least partially between the pick-up position and the application position, wherein the additional element guide comprises at least an inner guide surface and an outer guide surface provided to orient the additional elements and the packages relative to one another, wherein the at least two applicators each include a guide finger formed with the base and extends from the base and adjacent to the respective at least one application finger, in which the guide finger and the at least one application finger extend from opposing ends of the base, in which the at least two applicators are adjusted along the common, circumferential transport path from the pick-up position for picking up the additional elements to the application position for applying the additional elements to the packages and back, and in which the additional elements are pressed onto the packages in the application position respectively by the at least one application finger of the at least two applicators.

11. The method according to claim 10, in which the at least two applicators rotate about a circular path.

12. The method according to claim 10, in which when picking up the additional elements from the at least two applicators, the at least one application finger is adjusted against a restoring force, in which the additional elements are at least in sections held between the pick-up position and the application position by a spring-loaded, a preloaded, or a spring-loaded and preloaded application finger, in which the additional elements are at least in sections pressed between the pick-up position and the application position against the additional element guide for guiding the additional elements by the spring-loaded, the preloaded, or the spring-loaded and preloaded application finger, or in which the additional elements are pressed against the packages by the spring-loaded, the preloaded, or the spring-loaded and preloaded application finger in the application position.

13. The method according to claim 10, in which the additional elements are guided, held, or guided and held in an interlocking manner at least in sections between the pick-up position and the application position adjacent to the at least one application finger by the guide finger.

14. The method according to claim 10, in which the at least two applicators between the pick-up position and the application position are respectively pivoted about an orientation pivoting axis from a pick-up orientation to an application orientation, and in which the at least two applicators are pivoted about the orientation pivoting axis at least substantially perpendicular to the positioning axis of rotation of an applicator wheel and/or application carousel.

* * * * *